US006453806B1

(12) United States Patent
Bornhorst et al.

(10) Patent No.: US 6,453,806 B1
(45) Date of Patent: Sep. 24, 2002

(54) INFINITE VARIABLE SLIDE MOTION FOR A MECHANICAL POWER PRESS

(75) Inventors: John B. Bornhorst; Scott G. Temple, both of New Bremen, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 09/272,417

(22) Filed: Mar. 19, 1999

Related U.S. Application Data

(60) Provisional application No. 60/079,452, filed on Mar. 26, 1998.

(51) Int. Cl.[7] ..... B30B 1/06
(52) U.S. Cl. ..... 100/282
(58) Field of Search ..... 100/257, 280, 100/282

(56) References Cited

U.S. PATENT DOCUMENTS 5,468,194 A * 11/1995 Hayashi ..... 100/280

FOREIGN PATENT DOCUMENTS

| | | | | |
|---|---|---|---|---|
| GB | 1192544 | | 5/1970 | |
| GB | 1433112 | * | 4/1976 | ..... 100/282 |
| JP | 6-246500 | * | 9/1994 | ..... 100/282 |
| JP | 11-58091 | | 3/1999 | |
| SU | 335119 | | 5/1972 | |
| SU | 1274940 | * | 12/1986 | ..... 100/282 |

* cited by examiner

*Primary Examiner*—Stephen F. Gerrity
(74) *Attorney, Agent, or Firm*—Randall J. Knuth

(57) ABSTRACT

An infinite variable slide motion for a mechanical power press is achieved by use of a differential located on the press drive system. A differential movement mechanism is employed to rotate the differential relative to the drive system so that the output of the differential may be increased or decreased relative to the drive system.

14 Claims, 10 Drawing Sheets

Fig.4a
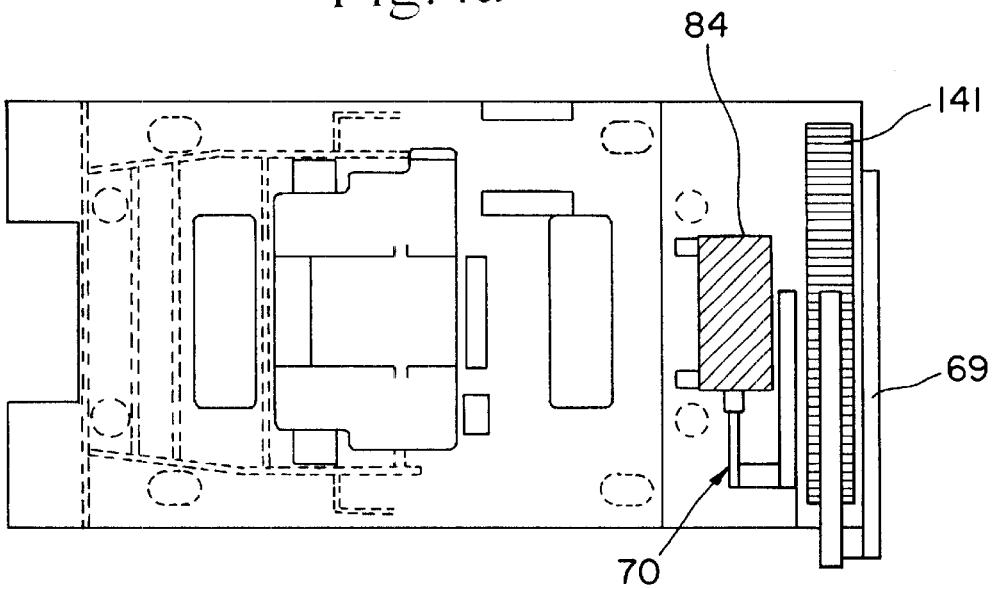
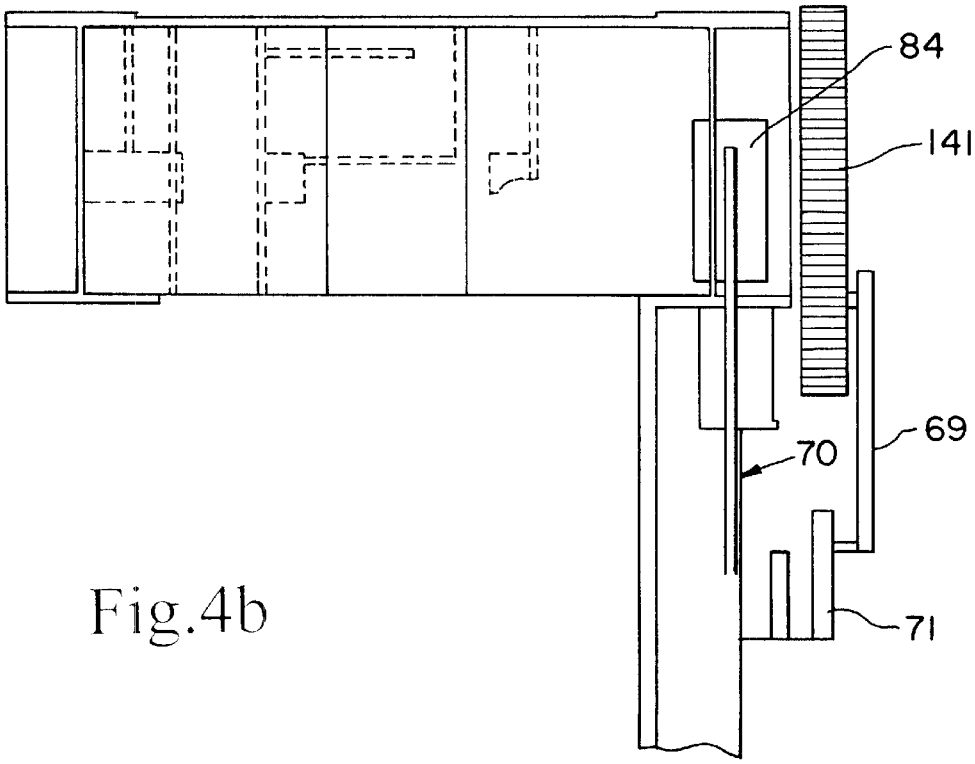
Fig.4b

INFINITE VARIABLE SLIDE MOTION FOR A MECHANICAL POWER PRESS

CROSS-REFERENCE TO RELATED APPLICATIONS

This application relates to and claims the benefit under 35 U.S.C. §119 of Provisional Application Serial No. 60/079,452 filed Mar. 26, 1998.

BACKGROUND OF THE INVENTION

1. Field of the Invention

The present invention relates to mechanical presses, and, more particularly, to a variable slide motion adjustment apparatus and method for changing the motion versus crankshaft angle curve of the press slide.

2. Description of the Related Art

Mechanical presses, for example, stamping presses and drawing presses, comprise a frame having a crown and bed. A slide is supported within a frame for motion toward and away from the bed. The slide is driven by a crankshaft having a connecting arm connected to the slide.

Such mechanical presses are widely used for stamping and drawing operations and vary substantially in size and available tonnage depending upon the intent of use.

After manufacturing of a mechanical press, the only way to change the slide motion or the usual slider crank motion of the slide, was to substitute new parts and particular sizes and gearing of the press. Additionally, a necessity was the use of a wrench or other hand tools to change particular settings on the apparatus thereof. A benefit in some types of press room operations would be the ability to change the slider crank motion to vary the speed and dwelling of the slide without such manual adjustments.

Of interest, in some mechanical presses, is that there are portions of the slide which may be actuated by a hydraulic cylinder hydraulic pressure in the same rectilinear direction as slide movement, so therefore the bottom of the slide may be controlled in an additional upward or downward direction during slide reciprocation. Such structure necessitates additional parts such as the hydraulic cylinders or hydraulic pressure application means, along with the various plumbing and controls that necessarily reciprocate with the slide. Such additional mass on the slide may cause problems in press balance during operation.

What is needed in the art is the ability to mechanically alter the slider crank motion of the slide without the use of wrenched or hand tools to maintain mechanical connections between all of the moving parts.

SUMMARY OF THE INVENTION

The present invention is directed to improve mechanical press slide motion control by creating an apparatus and method for allowing mechanical control of the slide motion versus crankshaft angle curve, thereby altering the speed position and dwell of the slide during operation.

The present invention provides an infinite variable slide motion control apparatus utilizing a differential disposed between the driveshaft and connection arms of the slide. Such a differential is controlled or adjusted by links connecting such differential to other operating gears. By varying positions of the links connected to the differential and their particular orientation relative to the gearing, the effective link length is adjusted, thereby changing the type of slide motion. Changes in slide motion may be used to obtain the best performance of a particular die used in production with the workpieces on the press. Such effective link length adjustment is controlled by use of a hydraulic motor within an encoder giving a pulse count of the position of the link being adjusted. By determining the effective location of the link to the associated gearing and differential control of the press slide, an effective press slide curve is created.

The invention, in one form thereof, comprises a mechanical press including a frame and bed connected together with a slide connected with the frame for reciprocating motion opposing the bed. In the preferred embodiment, the clutch is still engaged as conventionally utilized in the flywheel with the energy from the flywheel being transmitted to the slide through a driveshaft, main gears through a controlled differential to a crankshaft and slide connection arms. Differential mechanism operation is controlled via the position of a link and link spider arrangement connected either to the main gear of a press or to an auxiliary drive gear.

The invention, in another form thereof, includes a hydraulic cylinder, screw adjustment or other means to vary the effective position and/or length of a link or link spider connected to one of the main gear or drive gear of the press. Such changes in relative position of the link can cause the differential in a particular application, to control motion of the other operating portions of the press.

An advantage of the infinite variable slide motion system of the present invention is that now mechanical presses may control the motion versus crankshaft angle curve, with variable alternate slide motion curves as needed for particular press or drawing operations. Of particular interest is the ability to mechanically change the dwell of the press slide to maintain it for particular periods of time and crankshaft or driveshaft rotation.

Another advantage of the present invention is the ability to utilize a differential between the main gear and eccentric portions of the crankshaft, thereby obtaining particular control of the power applied thereto.

A further advantage of the invention is the ability to create a slide motion different from the normal slider crank motion to increase the dwell of the slide on the bottom for upwards of 25°±15°.

Yet another advantage of the present invention is the ability of the clutch to maintain fully engaged and transfer energy therefrom to the crankshaft and slide via entire mechanical connections.

Another advantage of the present invention is that the infinite variable slide motion may be adjusted without a wrench or hand tool, but by use of a hydraulic motor controlling the effective position or length of the control links utilized.

Yet another advantage of the present invention is that the system now allows dies and tooling to tap or draw at 90° from the bed during the vastly extended slide dwell period.

Still another advantage of the present invention is the creation of a substantially constant slide and die velocity during the bottom 25 percent of slide stroke.

A further advantage of the present invention is the ability to withstand overload hits without breaking the links between the slide and crankshaft. Stamping presses may take tremendous overload due to items left in the presses, and for other reasons. A conventional press with crankshaft connection slide can withstand such load, but presses with links between the crankshaft and slide for adjusting stroke have had trouble withstanding such severe overloads.

Another advantage of the present invention is on a high speed press a dynamic balancer may be adjusted at the same time as the slide motion is adjusted.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 4A is a top view of a portion of the press shown in FIG. 1;

FIG. 4B is a side view of a portion of the press shown in FIG. 1;

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
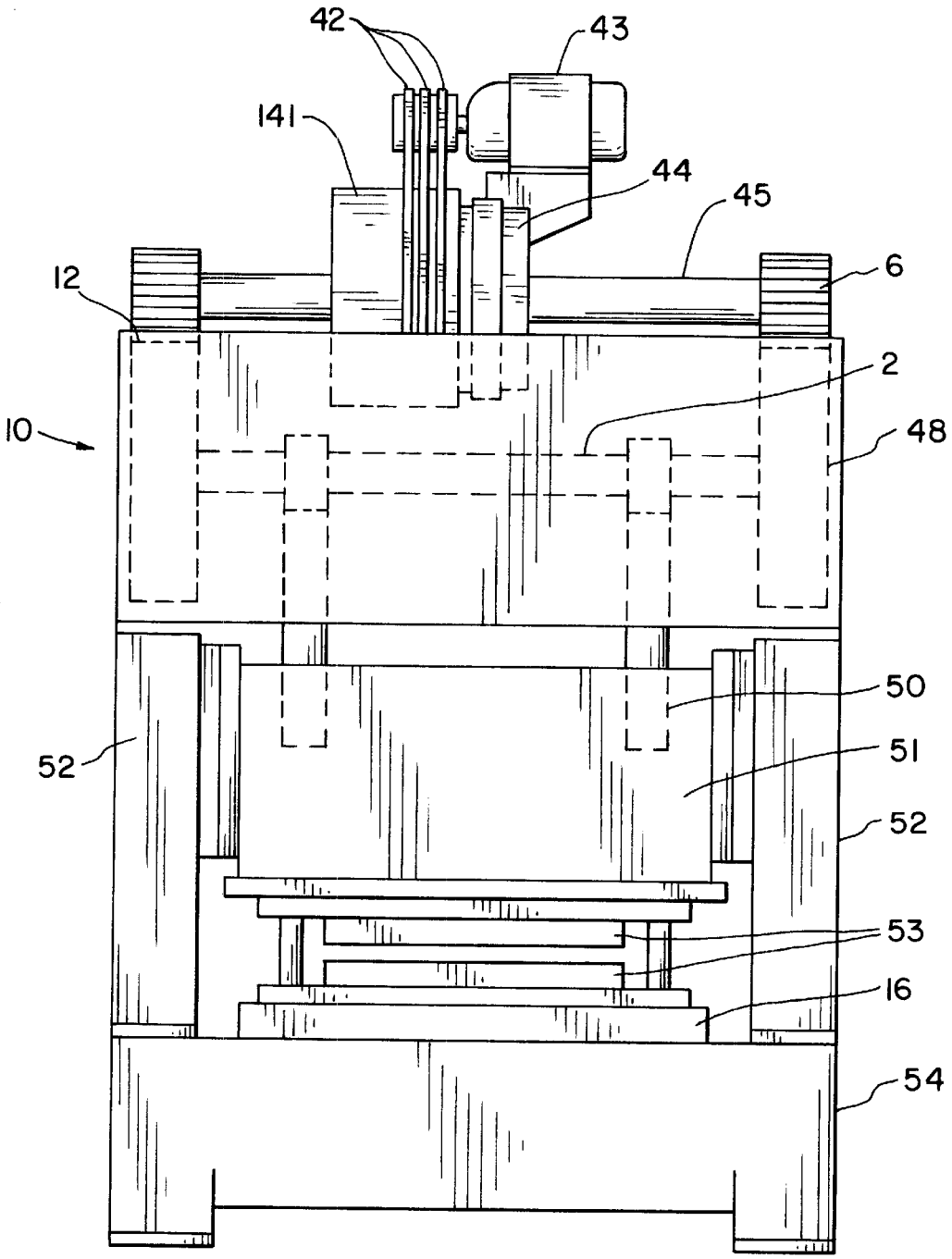
FIG. 1 is a elevational view of a mechanical press incorporating the infinite variable slide motion system of the present invention.

Referring now to the drawings and particularly to FIG. 1, there is shown a mechanical press 10 comprising a crown 12, a bed portion 54 having a bolster assembly 16 connected thereto, and uprights 52 connecting crown portion 12 to bed portion 54. Uprights 52 are connected to or integral with the underside of crown 12 and the upper side of bed 54. Die 53 is located between slide 51 and bed 54. Tie rods (not shown) extend through crown 12, uprights 52, and bed portion 54 and are attached on each end with a tie rod (not shown).

A drive mechanism, such as a press drive motor 43, is attached to crown 12 of the press and connected by belts 42 to a flywheel 141. Such flywheel 141 is thereby connected to a clutch/brake mechanism 44 that may transmit rotational energy to press driveshaft 45.

As shown in FIG. 1, press driveshaft 45 on opposite ends includes a pinion gear 6 engaging a main gear 49. Main gear 49 is connected to crankshaft 2 on which particular connections 50 attach to slide 51. Dies 53 are attached one each to both the slide 51 and bolster assembly 16.

Figure 2:
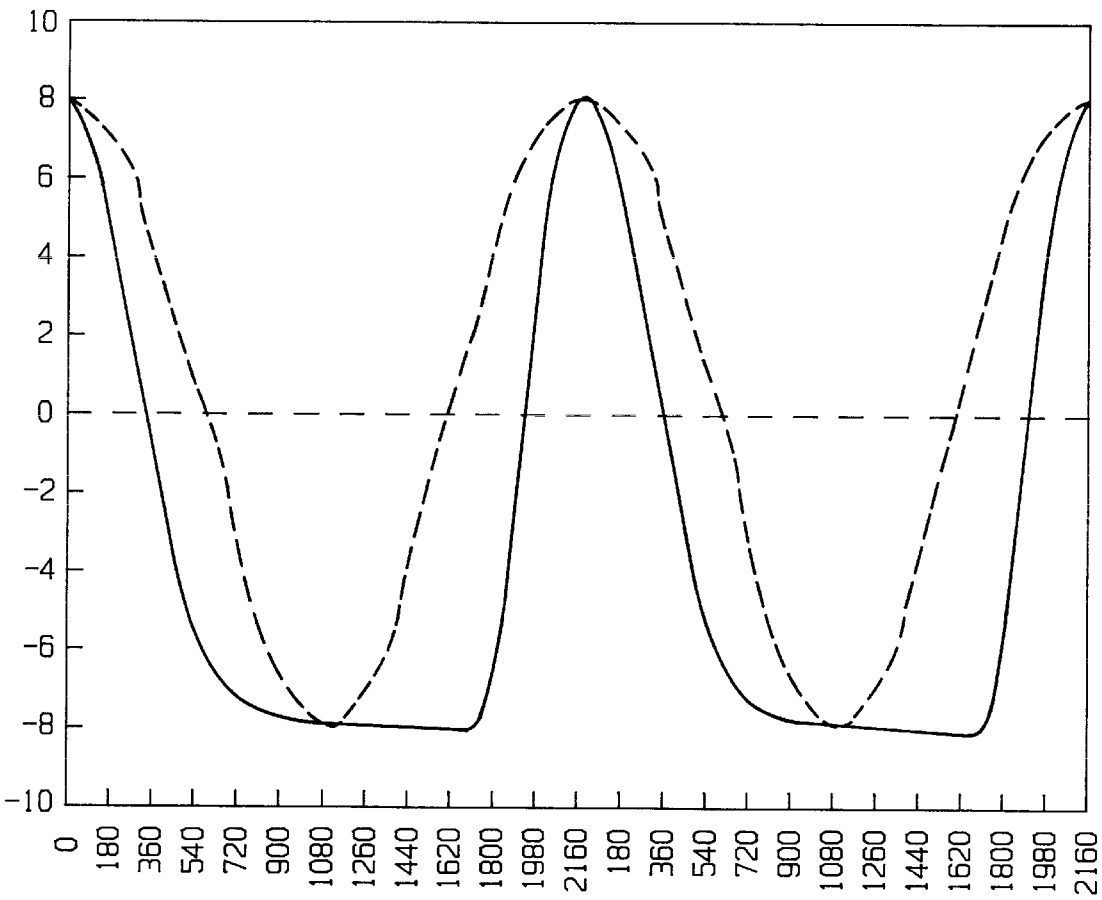
FIG. 2 is a graph showing a motion versus crankshaft angle curve for both a conventional press (dashed line) and one of the present invention (solid line)

The mechanical power press, as shown in FIG. 1, includes an eccentric (not shown) on crankshaft 2. A typical connection of the eccentric between the connection 50 and crankshaft 2 will create a slide motion curve as shown in FIG. 2 dashed line. This type of slide or crankshaft motion is similar to the majority of all mechanical presses.

Figure 3:
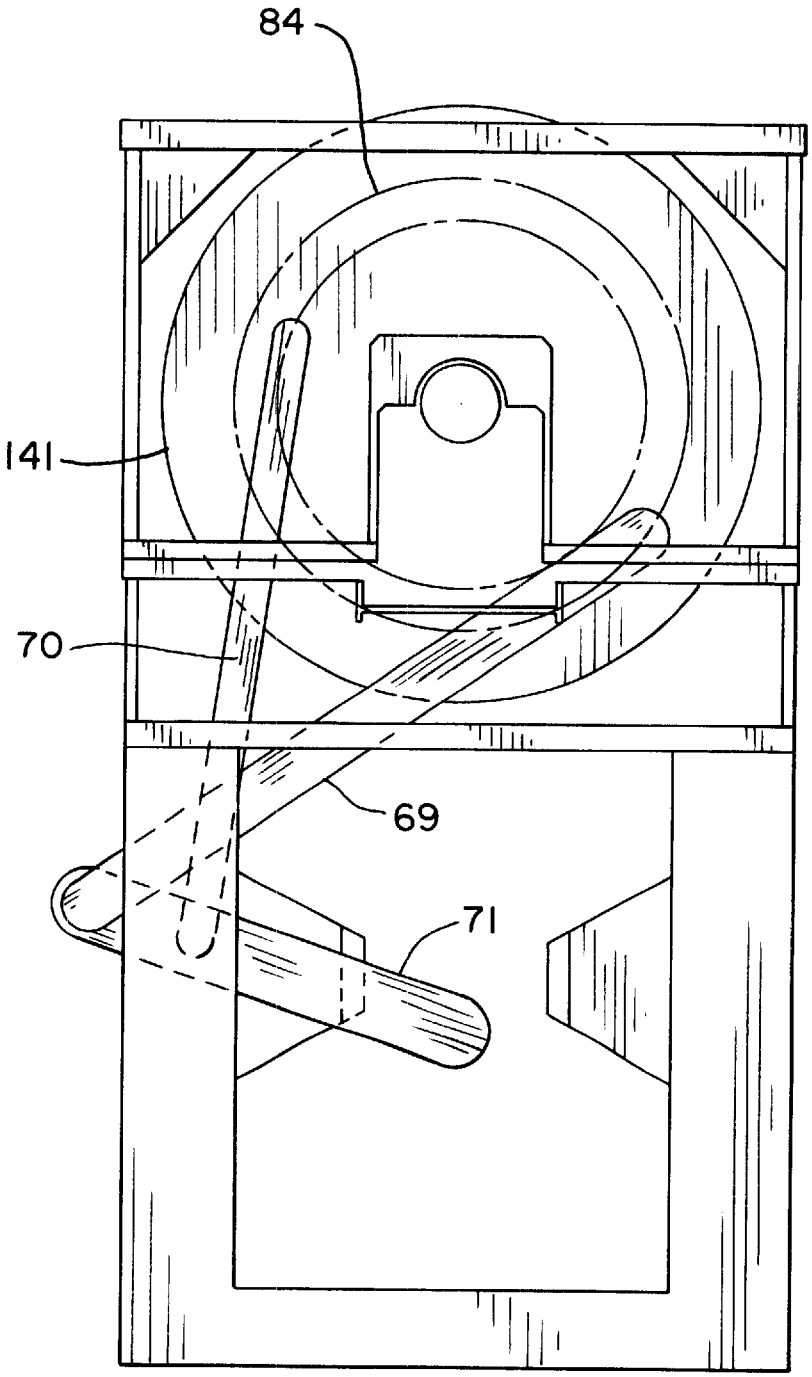
FIG. 3 is an end view of a portion of the mechanical press shown in FIG. 1.

FIG. 3 shows one view of the present invention, more particularly, the end view of the mechanical press of FIG. 1, in which the main gear 49 is connected by a link 69 to pivot link 71. Pivot link 71 is connected by a link spider 70 to differential 84. FIG. 4 shows a top and side view of the connection.

Figure 5:
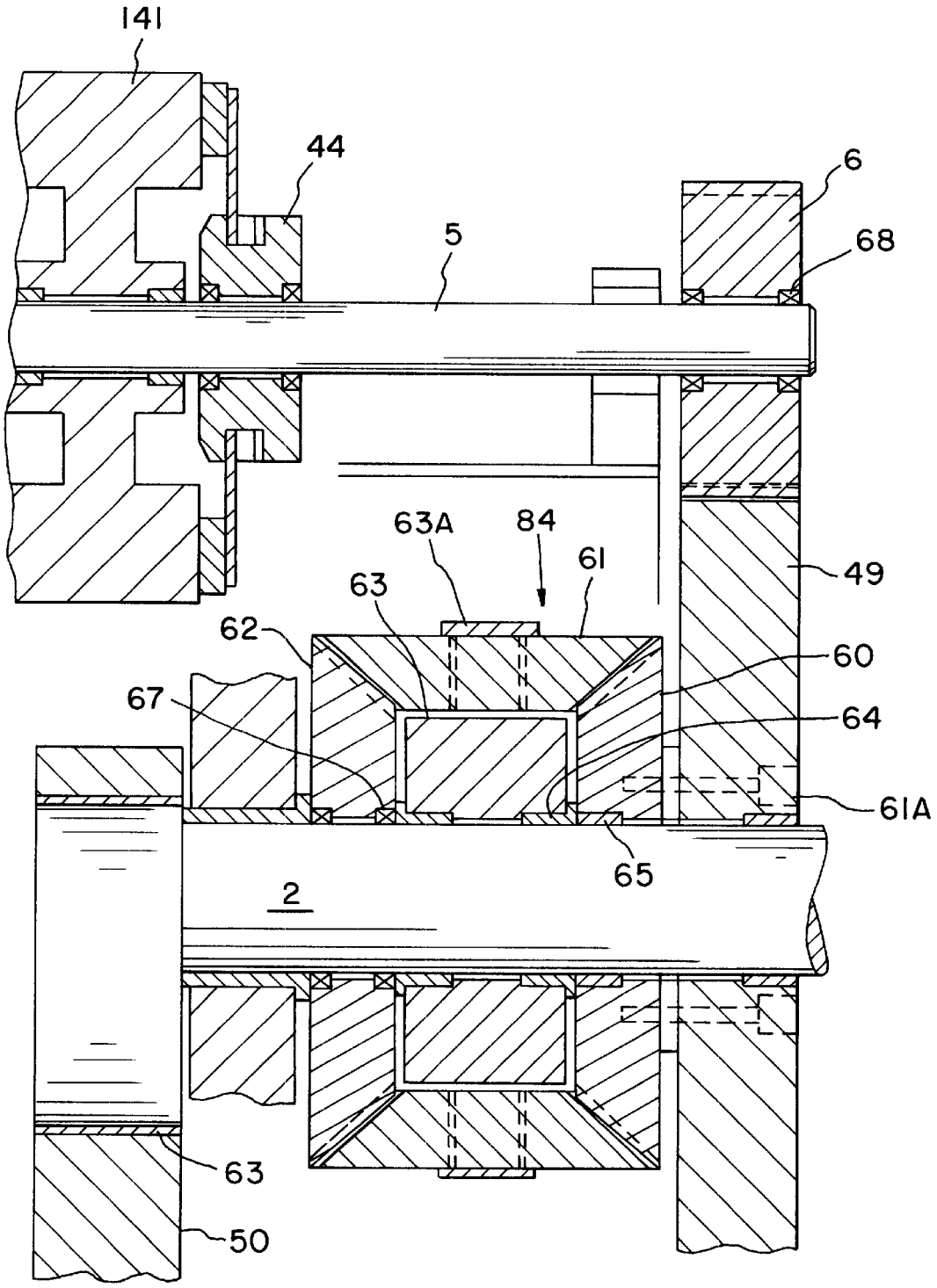
FIG. 5 is an engaged view of an embodiment of the drive mechanism of the present invention.

FIG. 5 shows an enlarged view of one particular drive mechanism of the present invention, in which the flywheel 141 is connected to a clutch 44 onto the driveshaft 5. A pinion 6 is thereby connected and rotates main gear 49.

Figure 6:
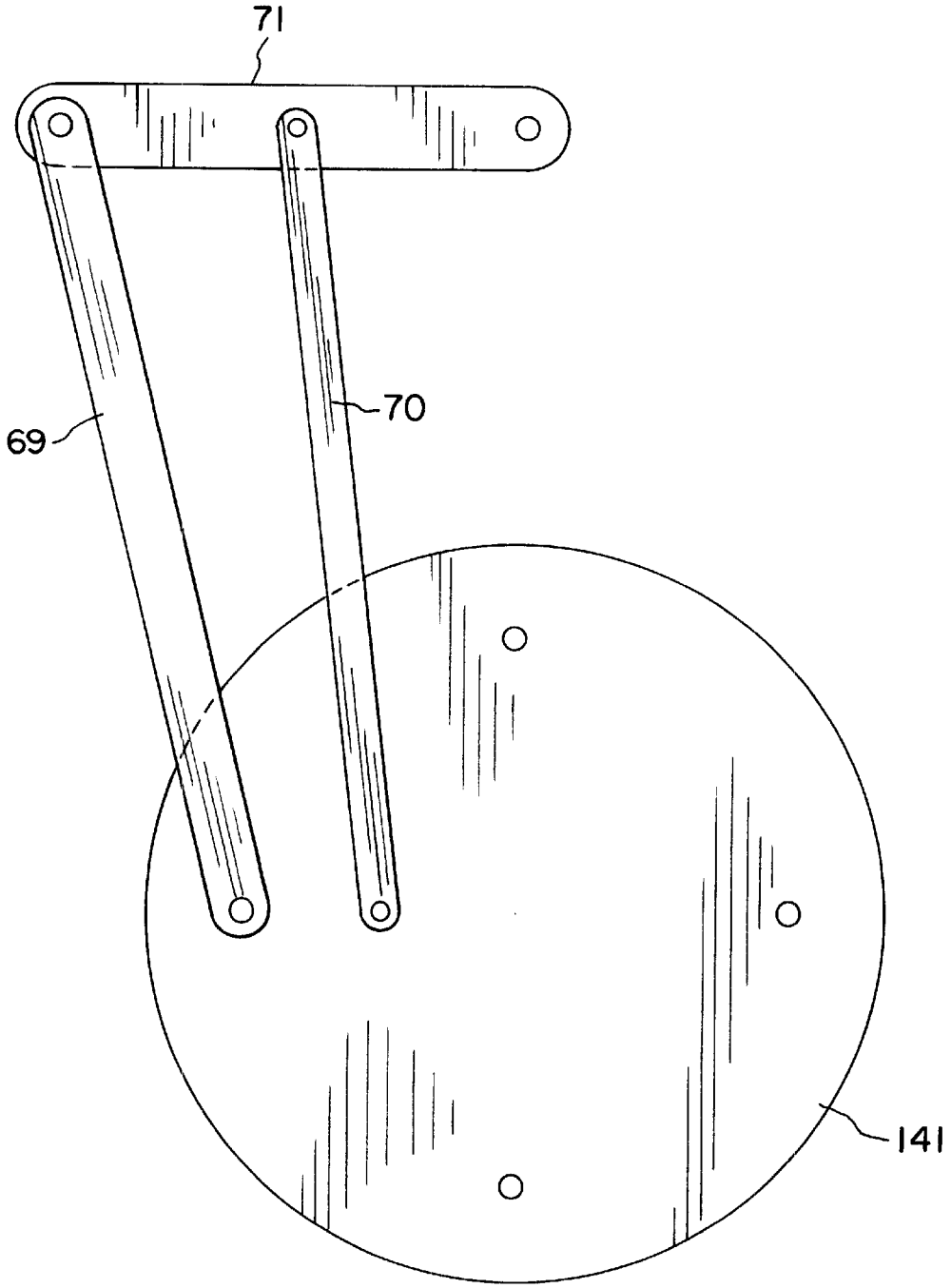
FIG. 6 is a diagram of the main gear, link pivot connection of one form of the invention.
Figure 10:
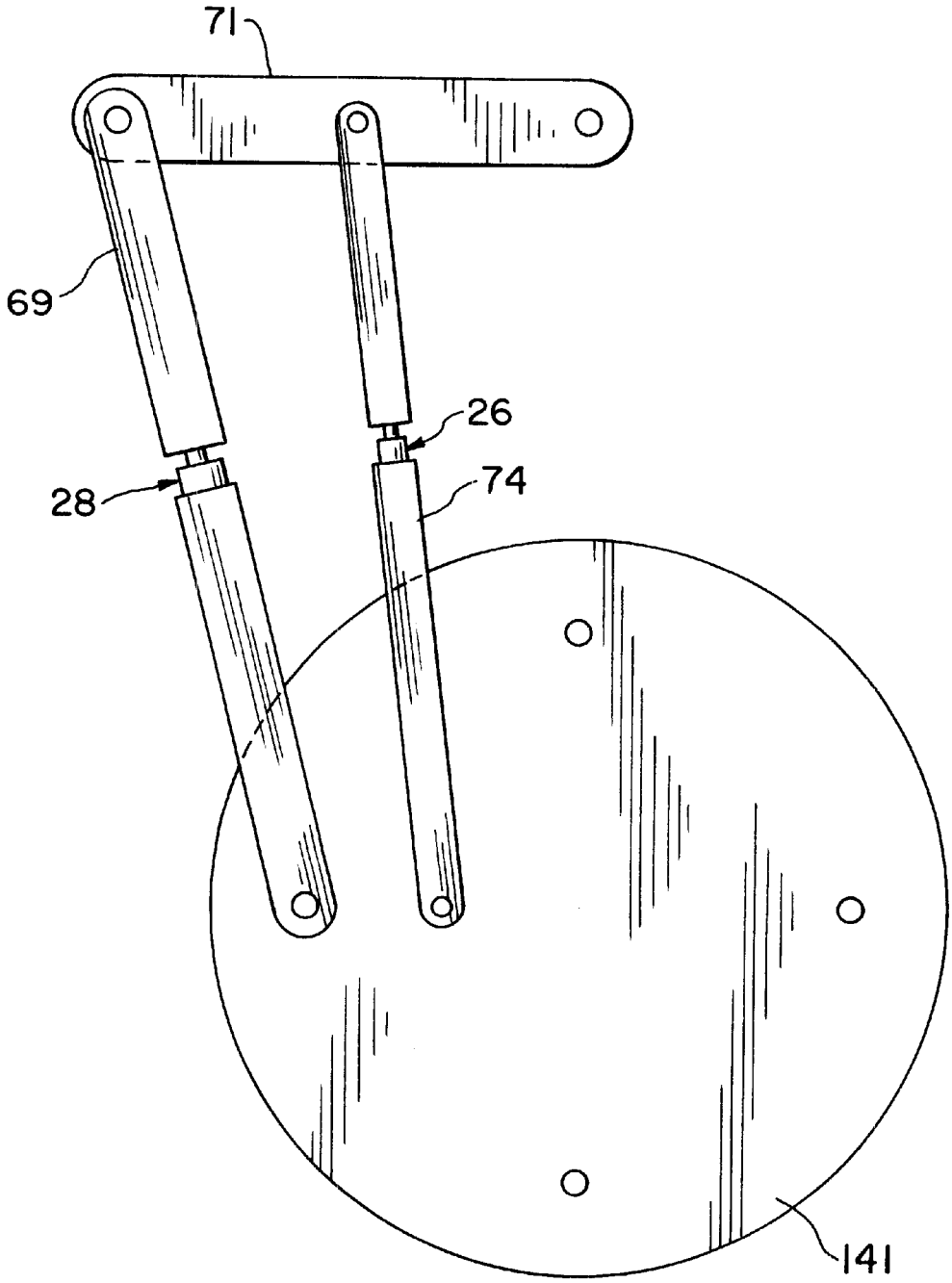
FIG. 10 is a diagram of the main gear link pivot connection including hydraulic cylinder length adjustment means for both the link main gear and the link spider.

FIG. 10 illustrates link main gear length adjustment means 28. Link main gear length adjustment means 28 can be, for example, a hydraulic cylinder. FIG. 6 also illustrates link spider length adjustment means 26, which can be, for example, a hydraulic cylinder.

The main gear 49 is fastened by bolt 61A to the input gear differential 60 as shown in FIG. 5 and is turned at a constant speed by pinion 6. The main gear 49 and input gear differential 60 are supported and rotate on the crankshaft bushing 65. The input gear differential 60 drives at least one pinion differential 61, which rotates on a shaft 63A on the spider differential 63. The spider differential 63 controls the shaft 63A through pinions 61. Spider differential 63 is controlled by link spider 70. Link spider 70 controls rotation of spider differential 63 about crankshaft 2. Pinion differential 61 drives gear output differential 62.

When the spider differential 63 rotation is changed, the pinion differential 61 alters the drive of output gear differential 62 and can stop the output gear 62 if the spider differential 63 rotation can substantially match in the reverse direction, the input gear differential 60. When the conditions are right, such that the differential slows or stops crankshaft 2 when slide 51 is down, the slide 51 may stop and dwell, thereby altering the slide motion curve. Spider differential 63 rotation combines with main gear 49, such that the output gear differential 62 may be faster or slower than main gear 49 depending upon how spider differential 63 is controlled. One particular curve is shown in FIG. 2 in which the dwell of the slide 51 is maintained longer at the bottom dead center position. Other times and locations of dwell may also be created.

In the preferred embodiment, the spider differential 63 movement is controlled by link spider 70. Link spider 70 is connected and pivoted on a link pivot 71 through a pivot pin. The link pivot 71 is pivoted about an axis (location "z") in FIG. 6. The link pivot 71 is pivoted by a link main gear connection 69 which is motivated (in this embodiment) by main gear 49.

The link main gear connection 69 pivots the link pivot 71 back and forth, and the link pivot 71 thereby drives link spider 70 which is fastened to spider differential 63, and thus controls spider differential 63 causing a change in the output differential 62 speed which is fastened to crankshaft 2.

Figure 7:
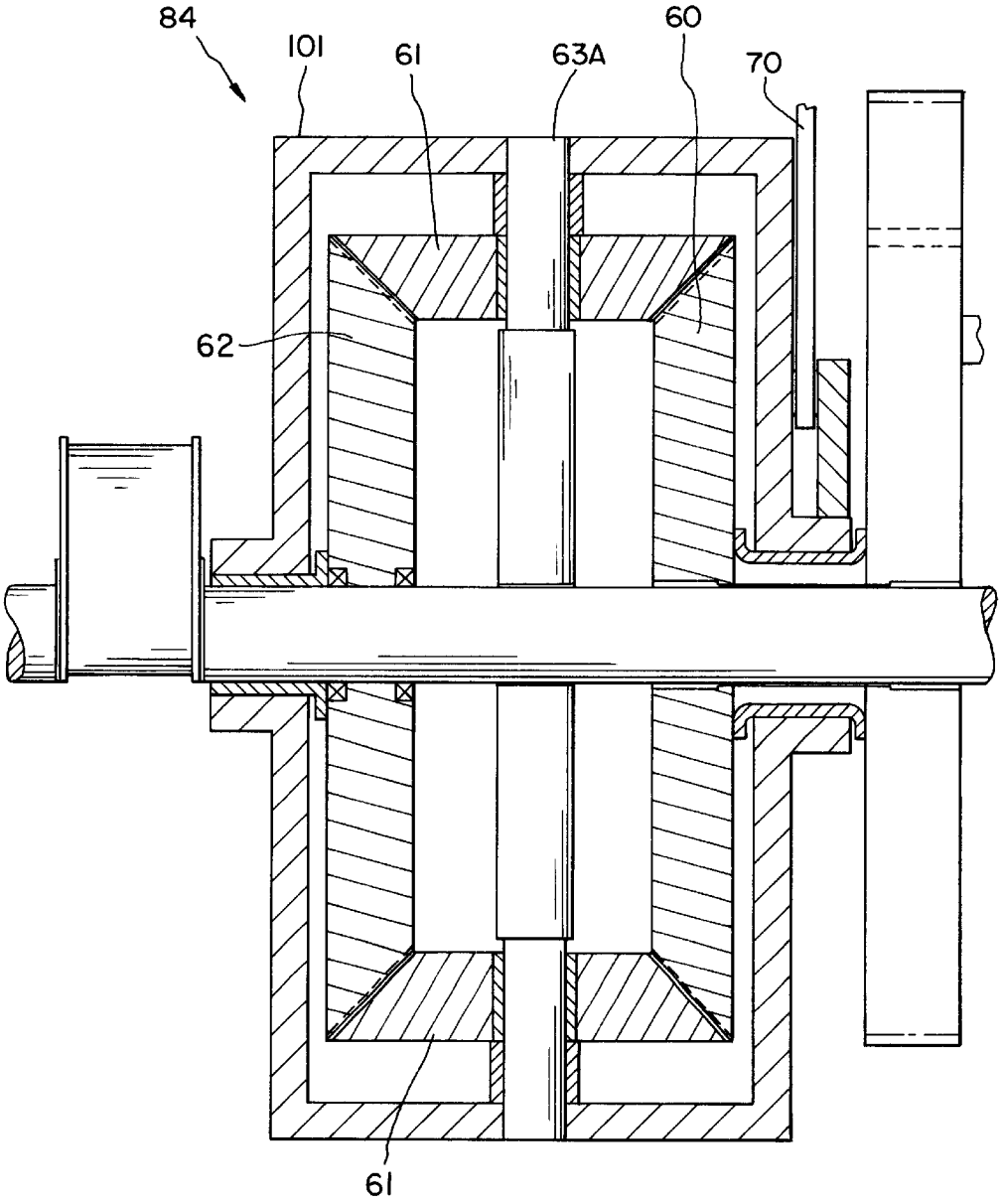
FIG. 7 is a section view of an embodiment of the differential utilized in the present invention.

FIG. 7 shows the differential 84 of the present invention, which includes the spider differential housing 101. It is to this housing 101 that the link spider 70 attaches.

Figure 8:
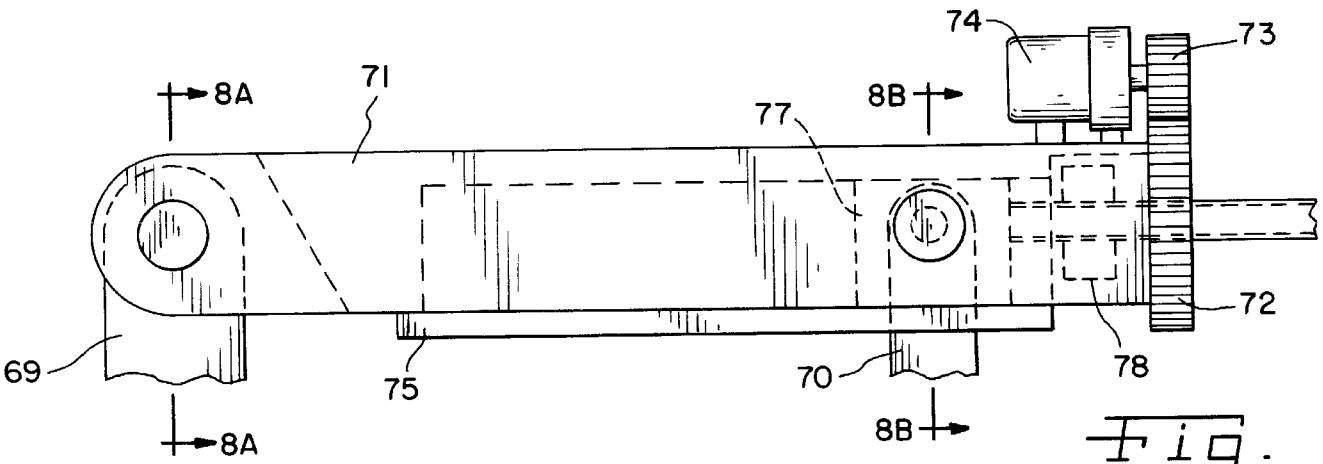
FIG. 8 illustrates means for effective link position length adjustment utilizing a hydraulic motor.
Figure 8B:
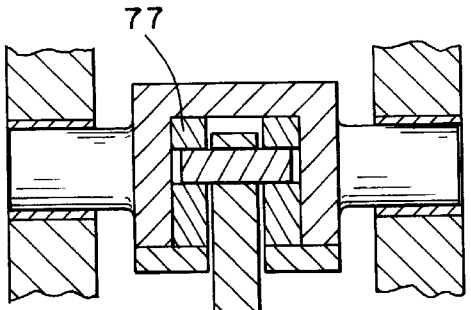
FIG. 8B is a sectional view of the spider link connection.
Figure 8A:
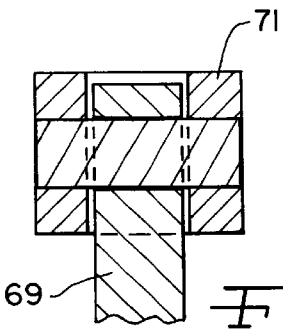
FIG. 8A is a sectional view of the main gear link connection.

As shown in FIG. 6, the link spider 70 connected to pivot link 71 may be adjusted forward and backward by the structure shown in FIG. 8, by varying the position of link spider 70 upon link pivot 71 as shown in FIG. 6, various slide motions occur.

Link spider 70 is attached, as shown in FIG. 8, to pivot link 71 by a pin link spider 80, mounted in a screw link spider 77. This screw link spider 77 is supported on three sides by pivot link 71 and held in place by retainer 75. The positioning of the screw link 77 is by a screw and nut link spider 78. The screw link spider 77 is part of the member that has the pin link spider 80 (see section B—B). A threaded portion is positioned by rotating a nut link spider 78. This nut link spider 78 includes pressurized oil to eliminate the need for a lock nut to prevent undamped clearance between the thread on nut link spider 78 and screw link spider 77. The nut link spider 78 is fastened to gear link pivot 72 by bolts and the gear transmits the power to the nut link spider 78. The gear link pivot 72 is driven by pinion link pivot 73, which is mounted onto a hydraulic motor 74. Hydraulic motor 74 obtains its hydraulic power from a power unit (not shown).

Additionally not shown, is an encoder mounted on the pinion link pivot 73 which feeds back pulses to a controller. A controller on this system controls and identifies the position of link spider 78 by counting particular pulses or otherwise determining its location. By rotating or operating hydraulic motor 74 which will rotate gear pivot 72, an extension or contraction of the screw link spider 77 occurs. Such extension and contraction of screw link spider 77 to which the link spider 70 is connected thereby changes the relative location of link spider 70 to link pivot 71. By controlling the relative position of link spider 70 and the link pivot 71, control of the slide 51 dwell is accomplished.

As illustrated in FIG. 10, control of the slide 51 dwell can also accomplished by altering the lengths of link spider 70 or link main gear 69. Length adjustment of the link spider can be accomplished by actuating link spider length adjustment means 26, for example, a hydraulic cylinder. Similarly, the length of the link main gear 69 may be adjusted by actuating main gear length adjustment means 28, for example, a hydraulic cylinder.

Figure 9:
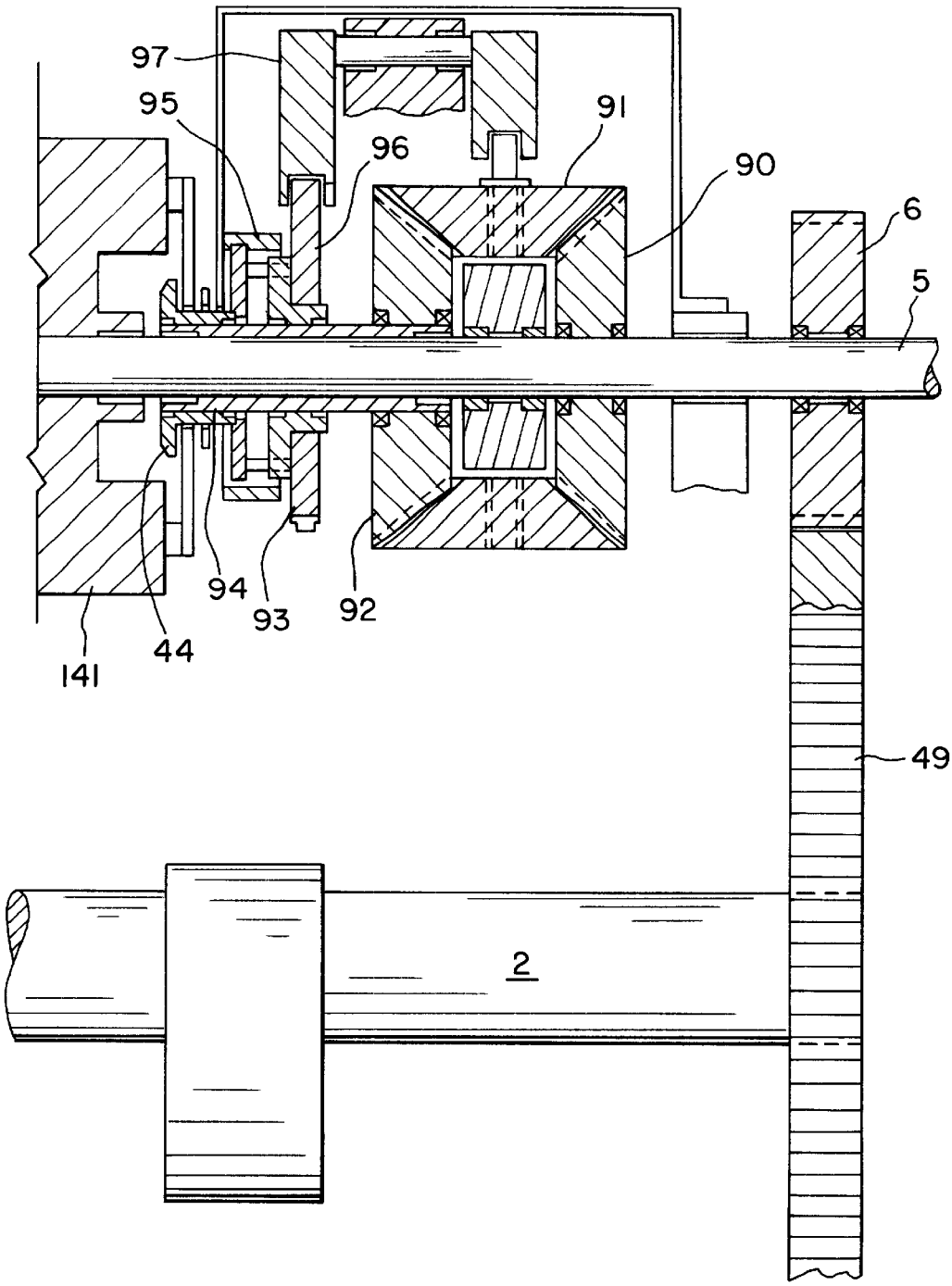
FIG. 9 is a section view of an alternate embodiment of the present invention utilizing planetary gears and connection of the differential to the press driveshaft.

As shown in FIG. 9, an alternate embodiment is used in which the differential is placed on the press driveshaft 5 as opposed to crankshaft 2. In this case, the system would need only a single differential versus two, such as when the press utilizes a twin drive setup as shown in FIG. 1. This would additionally reduce costs and the part count.

A particular problem concerning the timing of the eccentric crankshaft 2 to the spider occurs to the spider and on the driveshaft 5 differential. Additionally, there may be a requirement to reduce speed, which could be accomplished with a planetary gearing 95 between link spider 97 and clutch 44. The ratio would change in the planetary gearing when the ratio between the main gear and pinion 6 are changed. There may also be a required speed reduction between the link spider 97 and spider differential 63.

In all cases and embodiments, the differential 84 has to match the rotation of the crankshaft 2 or have a particular speed change depending upon the position of crankshaft 2. In other words, after one full rotation of the input occurs, one to the differential full rotation of the output also occurs. If the driveshaft spider differential has the correct change in motion, a curve as shown in FIG. 2 can be produced. If an adjustment of the position of the pivot on the link spider 70 is made, an infinite variable slide curve motion between the two curves may be made. Furthermore, this adjustment may be made via a control panel or remote personal computer. An additional benefit is that by locating the differential on the driveshaft as opposed to the crankshaft, a single dynamic balancer may be located between the connections and that the slide motion is changed, the balancer will be adjusted automatically if driven from the crankshaft. Therefore, no additional mechanisms are needed to adjust the dynamic balancer.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press, comprising:

a slide;

a press drive system to cause said slide to move, said press drive system having a press drive motor;

a driveshaft, said driveshaft having a first end and a second end, said first end connected to said press motor;

a pinion, said pinion connected to said second end of said driveshaft;

a main gear, said main gear driven by said pinion; and a crankshaft, said crankshaft having a first end and a second end, said first end of said crankshaft connected to said main gear; and a variable output differential operatively connected to said drive system, said variable output differential producing slide dwell, wherein said differential is rotatably supported by said crankshaft.

2. The press as recited in claim 1, further comprising:

differential movement means for rotating said differential relative to said drive system and thereby increasing or decreasing the output of said differential relative to said drive system.

3. The press as recited in claim 2, wherein said differential comprises:

an input gear differential, said input gear differential affixed to said main gear, said input gear differential rotatably supported by said crankshaft;

a pinion differential mechanically coupled to said input gear differential;

a shaft, said shaft rotatably supporting said pinion differential;

a gear output differential mechanically coupled to said pinion differential; and a differential housing.

4. The press as recited in claim 3, wherein said differential further comprises:

a second pinion differential mechanically coupled to said input gear differential and to said gear output differential; and a second shaft, said second shaft rotatably supporting said second pinion differential.

5. The press as recited in claim 2, wherein said differential movement means comprises:

a link spider pivotally connected to said differential housing;

a pivot link, having a first end and a second end, said pivot link pivoting about said second end, said link spider pivotally connected to said pivot link; and a link main gear, said link main gear pivotally connected to said first end of said pivot link, said link main gear pivoting said pivot link back and forth about said second end.

6. The press as recited in claim 5, wherein said link main gear is pivotally connected to said main gear.

7. The press as recited in claim 5, wherein said differential movement means further comprises:

adjustment means for varying the position of said link spider along said link pivot.

8. The press as recited in claim 7, wherein said adjustment means comprises:

a hydraulic motor;

a pinion link pivot, said pinion link pivot mounted on said hydraulic motor;

a controller for controlling and identifying the position of said link spider;

a gear link pivot driven by said pinion link pivot;

a nut link spider affixed to said gear link pivot;

a screw link spider threadedly connected to said nut link spider, said screw link spider supported on three sides by said pivot link, said nut link spider including pressurized oil to prevent undamped clearance between said screw link spider and said nut link spider;

a pin link spider for pivotally connecting said link spider to said screw link spider; and a retainer connected to said link pivot, said retainer holding said screw link spider in place within said pivot link.

9. The press as recited in claim 7, wherein said link spider further comprises:

link spider length adjustment means for varying the length of said link spider.

10. The press as recited in claim 9, wherein said link spider length adjustment means comprises:

a hydraulic cylinder.

11. The press as recited in claim 7, wherein said link main gear further comprises:

link main gear length adjustment means for varying the length of said link main gear.

12. The press as recited in claim 11, wherein said link main gear length adjustment means comprises:

a hydraulic cylinder.

13. A press, comprising:

a slide;

a press drive system to cause said slide to move, said press drive system having a press drive motor;

a driveshaft, said driveshaft having a first end and a second end, said first end connected to said press motor;

a pinion, said pinion connected to said second end of said driveshaft;

a main gear, said main gear driven by said pinion; and a crankshaft, said crankshaft having a first end and a second end, said first end of said crankshaft connected to said main gear; and a variable output differential operatively connected to said drive system, said variable output differential producing slide dwell, wherein said differential is rotatably supported by said driveshaft, includes a flywheel driven by said motor;

a clutch, said clutch being selectively engageable with said flywheel;

said driveshaft affixed to said clutch;

a pinion affixed to said driveshaft;

a main gear driven by said pinion; and said crankshaft affixed to said main gear.

14. The press as recited in claim 13, further comprising:

a planetary gearing, said planetary gearing mechanically coupled to said clutch; and a link spider, said link spider pivotally connected to said planetary gearing and to said differential.

* * * * *